United States Patent [19]

Kano et al.

[11] Patent Number: 4,940,421

[45] Date of Patent: Jul. 10, 1990

[54] WATER-PROOF ELECTRICAL CONNECTOR

[75] Inventors: Kouji Kano, Tokyo; Sumitaka Ogawa, Wako; Minoru Sano, Yamato; Masahiro Sakano, Yokohama, all of Japan

[73] Assignee: Molex Incorporated, Lisle, Ill.

[21] Appl. No.: 381,877

[22] Filed: Jul. 19, 1989

[30] Foreign Application Priority Data

Jul. 19, 1988 [JP] Japan ..... 63-95331[U]

[51] Int. Cl.[5] ..... H01R 13/52

[52] U.S. Cl. ..... 439/273; 439/274; 439/354

[58] Field of Search ..... 439/271–283, 439/587, 354

[56] References Cited

U.S. PATENT DOCUMENTS

| | | | |
|---|---|---|---|
| 3,937,545 | 2/1976 | Cairns et al. | 439/272 |
| 4,090,759 | 5/1978 | Herrmann, Jr. | 439/279 |
| 4,193,655 | 3/1980 | Herrmann, Jr. | 439/271 |
| 4,556,226 | 12/1985 | Ito | 439/273 |
| 4,621,883 | 11/1986 | Noguchi | 439/271 |

FOREIGN PATENT DOCUMENTS

| | | | |
|---|---|---|---|
| 0101155 | 2/1984 | European Pat. Off. | 439/272 |

*Primary Examiner*—David Pirlot

*Attorney, Agent, or Firm*—Louis A. Hecht; Stephen Z. Weiss

[57] ABSTRACT

Disclosed is an improved multi-pin type of water proof electric connector which is guaranteed free of shortcircuit between adjacent pin-and-contact piece connections even if water should invade to any pin-and-connector piece connection through the very small gap between the conductor and the insulation sheath of the wire by the capillary action. The electric connector comprises a male half having contact pieces and a female half having pin terminals in its cavity, and a seal member placed in the space which is to be formed between the outer surface of the plug housing and the inside surface of the socket housing when the male and female halves are coupled. The plug housing has a plurality of hollow protrusions each containing a contact piece, and the seal member encircles each of the protrusions, thereby sealing each pin-and-contact piece connection independently from adjacent pin-and-contact piece connections when the male and female halves are mated.

3 Claims, 3 Drawing Sheets

1
2
3
4
5
6a
6b
7
8
9
10a
10b
11
12
13a
13b
14
15
16
17
18
19a
19b
20
21
22
23
24
25
26
27
28
29
30
31
32a
32b
32c
33

WATER-PROOF ELECTRICAL CONNECTOR

BACKGROUND OF THE INVENTION

The present invention relates to a waterproof type of electric connector, more particularly to such an electric connector for use in connecting electric machines and apparatus to an electric power supply born in transportation means in such a water-tight fashion that no electric shortcircuit between conductors be caused by water invasion due to the capillary action in thhe very small gap between the core and the insulation sheath of an insulated wire. Such a water invasion due to the capillary action in the very small gap between the core and the insulation sheath of a selected insulated wire is likely to take place in case where the end of the insulated wire opposite to that of the insulated wire which is connected to the electric connector, is exposed to the surrounding atomosphere.

DESCRIPTION OF THE PRIOR ART

As is well known, many electric connectors are used in connecting the wires extending from electric machines and apparatus to the wires extending from a power supply on transportation means. Such electric connectors must meet some requirements. Among these requirements the waterproofness is of great concern. Several waterproof constructions have been proposed and actually used. As is well known, a multi-pin connector comprises male and female halves. The male half has a plurality of female contact pieces, and the female half has a hollow to detachedly accept the housing of the male half, and a plurality of pin terminals fixed to the bottom of the hollow of the female half in such an arrangement that these pin terminals mate with corresponding female contact pieces when the male half is inserted in the hollow of the female half. The waterproof construction of such a multi-pin connector consists of a first water-tight seal to prevent water-invasion between the wire conductors and the male half housing, a second water-tight seal to prevent water-invasion between the wire conductors and the female half housing, and a third water-tight seal to prevent water-invasion between the male half housing and the female half housing. As regards the first and second water-tight seals these seals are packings encincling the wire conductors and the pins. As regards the third water-tight seal it is a seal member to be placed in the gap between the abutting ends of the male and female halves when nested, thereby preventing water-leak to a group of female contact pieces and a corresponding group of pin terminals. Different seal members are proposed and actually used.

Conventional electric connectors actually used are found to be satisfactory in water-proofness between the wire conductors and the male half housing, the pin terminals and the female half housing and the male and female housings, but are found to be unsatisfactory in preventing water from invading into the place at which pin termials and corresponding female contact pieces are connected. Such water invasion is caused by the capillary action in the very small gap between the conductor and sheath of a selected insulated wire.

The applicant has found that such water invasion is caused by the capillary action between the conductor and the insulation sheath of an insulated wire whose end is exposed to the surrounding atmosphere. This water invasion cannot be prevented by the sealing structure which is designed only for preventing water from invading from the outside of the electric connector. The conventional sealing structure fails to seal between adjacent pin-and-contact connections, and therefore, an electric shortcircuit can appear between adjacent pin-and-contact connections in case where the ends of the insulated wires are exposed to the surrounding atmosphere. Such electric shortcircuit will cause an adverse effect in associated electric apparatus and power supply.

SUMMARY OF THE INVENTION

The object of the present invention is to provide a waterproof type of electric connector which can prevent water invasion from the outside of the electric connector, and can prevent an electric shortcircuit between adjacent pin-and-contact piece connections even if water should invade into a selected pin-and-contact piece connection through the very small gap between the conductor and the insulation sheath of a selected insulated wire, such water invasion being caused by the capillary action in the very small gap between the conductor and the insulation sheath of the insulated wire.

To attain this object a waterproof type eletctric connector which comprises a male half and a female half, said male half including a plug housing having a plurality of contact pieces detachably fitted therein, said female half including a socket housing having a hollow to detachably accept said plug housing a plurality of pin terminals fixed to the bottom of said hollow in such an arrangement that the pin terminals mate with corresponding contact pieces when said male half is inserted in said hollow of said female half, and a seal member placed in the space which is to be formed between the outer surface of said plug housing and the inside surface of said socket housing when said male and female halves are combined thereby preventing water from invading the inside of the electric connector, is improved according to the present invention in that said plug housing has a plurality of hollow protrusions each having a cylindrical cell to permit each of said contact pieces to fit in, said seal member encircling each of said protrusions, thereby sealing each pin-and-contact pieces connection independently from adjacent pin-and-contact piece connections.

The seal member which encircles each protrusion to seal each pin-and-contact piece connection independently from adjacent pin-and-contact piece connections, may be of a unitary structure, which has a front surface, a rear surface, a circumferential side connecting the front and rear surfaces, and a prularity of through holes each permitting a corresponding protrusion to enter, said seal member being placed with its front surface on the bottom of said hollow and with its circumferential side on the inside circumference of said hollow, each of said through holes having hills and valleys alternately formed on its inside surface, the hills of each through hole being pressed against the outer surface of a corresponding protrusion. Advantageously, the unitary seal member can be easily made.

Preferably, a waterproof type of electric connector may have a seal stopper placed in said hollow with its front end on the rear surface of said seal member and with its outer circumferential surface on the inside circumferential surface of said hollow, whereby said stopper is sandwiched between said socket housing and said plug housing to hold said seal member in place when said male and female housings are coupled. The stopper is useful in preventing undesired displacement of the seal member when the male and female halves are repeatedly coupled and decoupled. The contact pieces may be of pressure-contact type. Even if water should invade into the place at which a selected terminal pin is to be coonnected to a corresponding contact piece through the very small gap between the conductor and the insulation sheath of the insulated wire, the water cannot invade the adjacent pin-and-contact piece connections when the male and female halves are mated with each other because each pin-and-contact piece connection is contained in the hollow protrusion, and each protrusion is encircled by the sealing member. Thus, there can be no electric short-circuit between adjacent pin-and-contact piece connections.

The seal member encircling each and every protrusion can be of a unitary form, and in this case the unitary seal member can be easily formed and fitted to the protrusions of the male half, assuring the perfect sealing of each pin-and-contact piece connection.

The seal member has a wavy surface on the side on which it contacts the protrusions of the male half, and therefore it can push itself against the protrusions of the male half in such a resilient fashion that the seal member fits very closely to the outer surface of each protrusion to assure complete water-tightness.

Other objects and advantages of the present invention will be understood from the following description of a waterproof type of electric connector according to one preferred embodiment of the present invention, which is shown in accompanying drawings:

FIG. 8 is a front view of a seal stopper:

FIG. 13 is a section of the seal stopper taken along the line 13—13 in FIG. 10.

DESCRIPTION OF PREFERRED EMBODIMENTS

Figures 1, 2, 3:
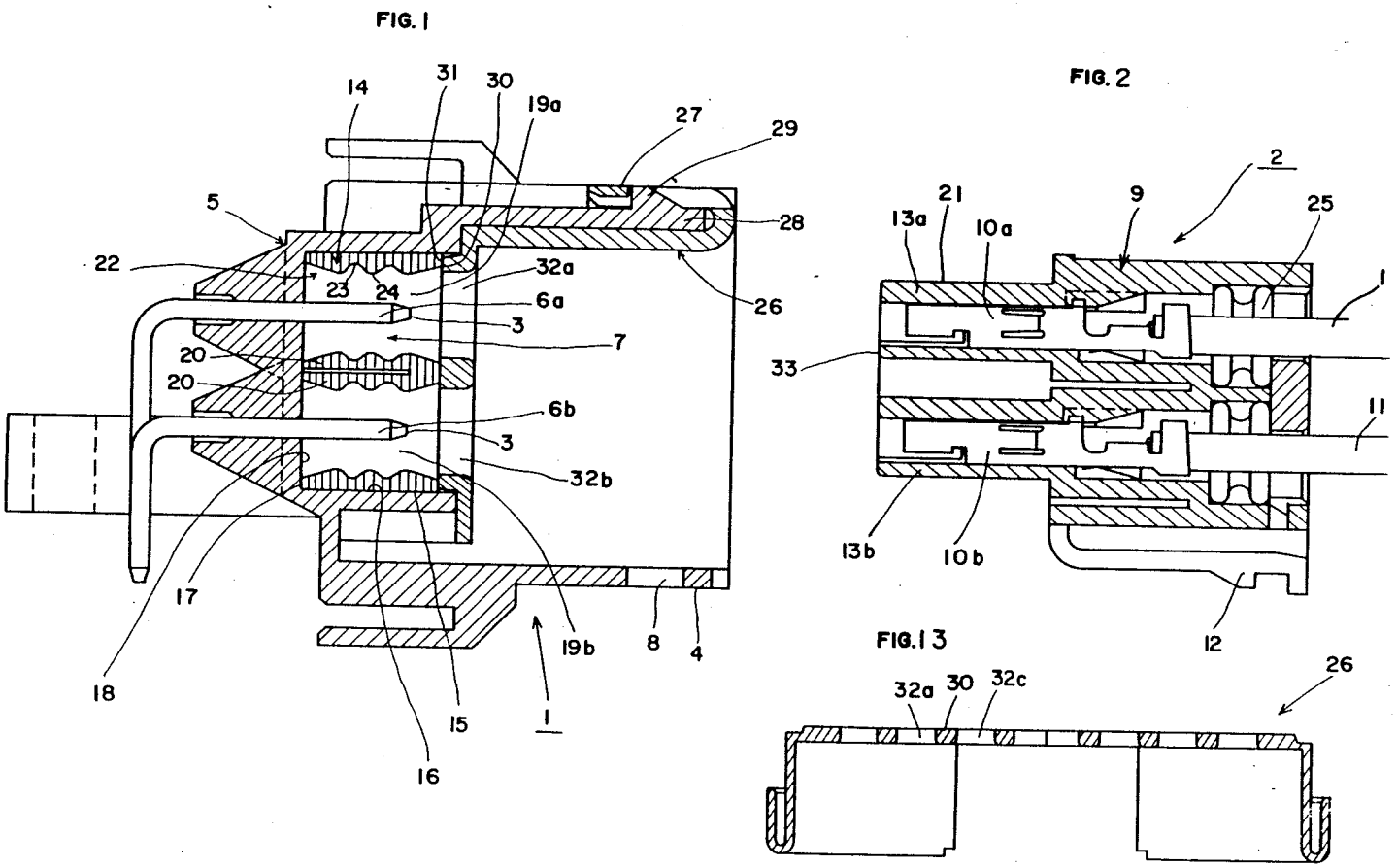
FIG. 1 is a longitudinal section of a female half of the waterproof type of electric connector taken along a line extending across the female half between selected adjacent pin terminals, which are staggered in arrangement.
FIG. 2 is a longitudinal section of a male half of the waterproof type of electric connector taken along a line extending across the male half between selected adjacent contact pieces, which are also staggered in arrangement.
FIG. 3 is a longitudinal section of the male and female halves which are mated together.
Figure 4:
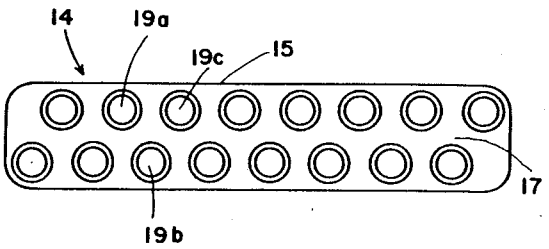
FIG. 4 is a front view of a seal member.
Figure 5:
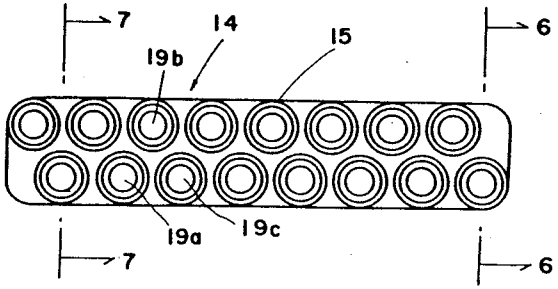
FIG. 5 is a rear view of the seal member.
Figure 3:
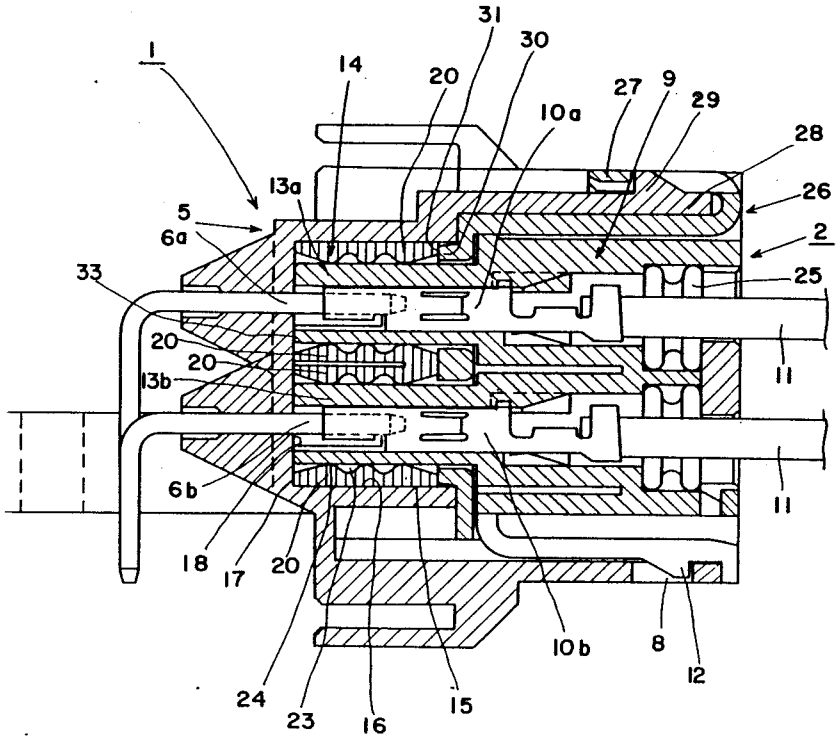
Figure 11:
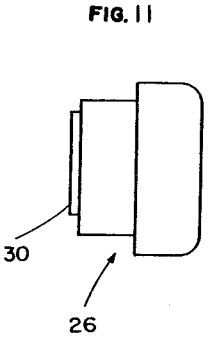
FIG. 11 is a side view of the seal stopper as viewd from the right.
Figure 12:
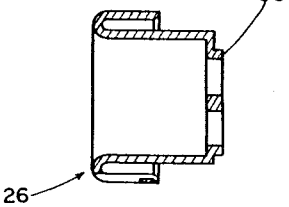
FIG. 12 is a section of the seal stopper taken along the line 12—12 in FIG. 10.
Figure 8:
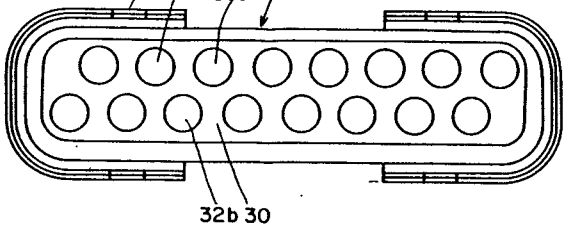
FIG. 8 is a section of the seal member taken along the line 6—6, in FIG. 5.
Figure 9:
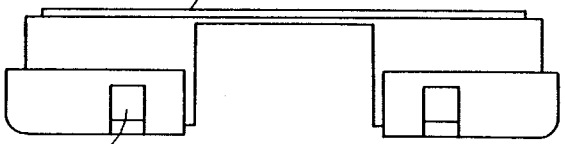
FIG. 9 is a plane view of the seal stopper.
Figure 10:
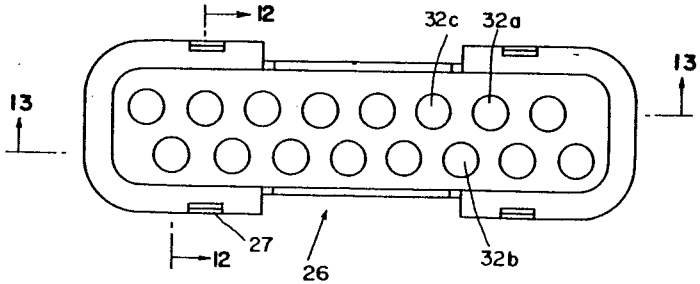
FIG. 10 is a rear view of the seal stopper.
Figure 6:
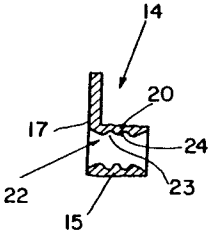
Figure 7:
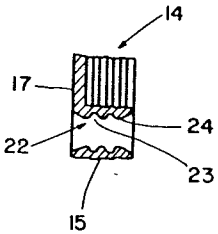
FIG. 7 is a section of the seal member taken along the line 7—7 in FIG. 5.

FIG. 1 shows a female half 1 of a multi-pin type of electric connector, and FIG. 2 shows a male half of the electric connector.

FIG. 3 shows the male and female halves when mated together. The electric connector has a plurality of pin terminals 6a and contact pieces 10a arranged in staggered relation. FIGS. 4 to 7 show a seal member 14, and FIGS. 8 to 13 show a seal stopper 25.

As shown in FIGS. 1 to 3, the female half 1 comprises a female housing 5 and a plurality of pin terminals 6a, 6b fixed to the female housing 5. The female housing 5 has a cavity 7 to accept a male half 2. The tips 3 of the pin terminals 6a, 6b appear in the cavity 7 of the female half 1. The female or socket housing 5 has apertures 8 at its open edge 4 to catch the projections 12 of the male or plug housing 9.

As shown in FIG. 2, the male half 2 comprises a male or plug housing 9 and a plurality of contact pieces 10a, 10b fixed to the plug housing 9. The conductor of an insulated wire 11 is connected to each contact piece 10a, 10b.

As a matter of course, the pin terminals and the contact pieces are so arranged in the female half and the male half respectively that the pin terminals and the contact pieces are aligned with each other when the female half and the male half are put in registration to be mated. In this particular embodiment the contact pieces 10a, 10b are of press-contact type.

The electrical connector structure described so far is well known, and such a multi-pin type of electrical conector is modified according to the present invention as follows.

First, a plurality of hollow protrusions 13a, 13b are integrally connected to the plug housing 9 to contain a corresponding plurality of coontact pieces 10a, 10b. When the male half 2 is inserted in the female half 1, the pin terminals 6a, 6b will be automatically fitted in the contact pieces 10a, 10b. Thus, the pin-and-contact piece connections will contained in the hollow protrusions 13a, 13b of the plug housing 9.

As seen from FIG. 1, a seal member 14 is placed in the cavity 7 of the socket housing 5 so that the seal member 14 may each protrusion 13a, 13b. In this particular embodiment seal member 14 is of a unitary body. The seal member 14 will be described below in detail with reference to FIGS. 4 to 7. The seal member 14 has a front surface 17, a rear 31, a circumferential side 15 connecting the front and rear surfaces, and a prularity of through holes 19a, 19b, 19c each permitting a corresponding protrusion 13a, 13b to enter therein. The seal member 14 is placed with its front 17 on the bottom 18 of the cavity 7 and with its circumferential side 15 on the inside circumference 16 of the cavity 7. Each protrusion is encircled as indicated at 20 by seal member 14.

The front 17 of each seal portion 20 is put in contact with bottom surface 18 of the cavity 7 of the socket housing 5. Each seal portion 20 has hills 24 and valleys 23 alternately formed on its inside surface 22. The hills 24 of each portion 20 are pressed against the outer surface 21 of a corresponding protrusion.

When the male half 2 is mated with the female half 1 by inserting the plug housing 9 into the cavity 7 of the socket housing 5, all protrusions 13a, 13b of the plug housing g will inserted in the cells 19a, 19b, 19c of the seal member 4, and then, each protrusion 13a, 13b and hence the pin-and-contact piece connection will be sealed independently completely by seal portion 20.

The water invasion through the gap between the outer surface of the plug housing 9 and the inner surface of the socket housing 5 will be prevented because the circumferential side 15 of the seal member 14 is closely laid on the inner surface 15 of the cavity 7 of the socket housing 5. The gap between each pin terminal 6a, 6b and the socket housing 5 is sealed appropriately, and the gap between each insulated wire 11 and the plug housing 9 is sealed for instance by packings 25.

In this particular embodiment a seal stopper 25 (See FIGS. 8 to 13) is placed in the cavity 7 with its front end 30 on the end 31 of the seal member 14 and with its outer surface on the inside surface of the cavity 7. Thus, the stopper 26 is sandwiched between the socket housing 5 and the plug housing 9 to hold the seal member 14 in place when the male female housings are coupled.

One end 27 of the seal stopper 26 is caught by engagement projections 29 of the open edge 28 of the socket housing 5, whereas the other end 31 of the seal stopper 25 abuts the rear end 31 of the seal member 14. The outer circumference of the seal stopper 26 is laid on the inner wall of the cavity 7 of the socket housing 5. This seal stopper 26 is made in a unitary form, having a plurality apertures 32*a*, 32*b*, 32*c* to accept the protrusions 13*a*, 13*b* of the plug housing 9. Thus, when the male and female housings 9 and 5 are coupled, the protrusions 13*a*, 13*b* of the plug housing 9 will pass through these apertures 32*a*, 32*b*, 32*c*.

The seal portions 20 of the seal member 14 abut on the aperture edges of the stopper 26 so that the seal member 14 is held in place. Each seal portion 20 encircles a corresponding protrusion 13*a*, 13*b*, and likewise, each aperture edge of the seal stopper 26 encircles the protrusion 13*a*, 13*b*.

When in use, the male and female halves 2 and 1 are mate together by inserting the male half 2 into the female half 1, the protrusions 13*a*, 13*b* of the plug housing 9 pass through the apertures 32*a*, 32*b*, 32*c* of the seal stopper 26 to enter the cells 19*a*, 19*b*, 19*c* of the seal member 14. In this position each pin terminal 6*a*, 6*b* is connected to the counter contact piece 10*a*, 10*b*, as shown in FIG. 3. Assume that the water invasion to a selected pin-and-contact piece connection (6*a*+6*b*) is caused by the capillary action through the very small gap between the conductor and the insulation sheath of the insulated wire. The water proceeds along the wall of the cell to leak through the gap between the tip end 33 of the protrusion 13 and the bottom 18 of the cavity 7 towards the adjacent cell in which the pin terminal 6*b* is connected to the contact piece 10*b*.

The protrusion 13*a* is encircled by the seal portion 20 of the seal member 14 with the end 17 of the seal portion 20 pushed against the bottom 18 of the cavity 7, thus preventing the water from leaking into the adjacent cell through the gap between the tip end 33 of the protrusion 13 and the bottom 18 of the cavity 7. As seen from FIG. 3, the crests of the wavy inner surface of each seal portion 20 are pushed against the outer surface of the protrusion 13*a*, thus preventing the water from leaking into the adjacent cell along the outer surface of the protrusion 13*a*. Thus, all pin-and contact piece connections are sealed water-tight independently from each other, thereby preventing an electrical short-circuit between adjacent pin-and-contact piece connections.

The seal member 14 is held by the seal stopper 26 in position, and therefore, the seal member 14 cannot be displaced from the prescribed position even when the male and female halves 2 and 1 are repeatedly coupled and decoupled.

Each seal portion 20 is held in position by abutting a corresponding aperture edge 30 of the seal stopper 26 against the seal portion 20, thus assuring the close contact between every crest 24 of the wavy inner surface of the seal member 14 and the outer surface of the protrusion 13*a*, 13*b*, thus increasing the sealing effect.

What is claimed is:

1. A waterproof type of electric connector comprising a male half (2) and a female half (1), said male half (2) including a plug housing (9) having a plurality of contact pieces (10*a*, 10*b*) detachably fitted therein, said female half (1) including a socket housing (5) having a cavity (7) to detachably accept said plug housing (9), a plurality of pin terminals (6*a*, 6*b*) fixed to the bottom of said cavity in such an arrangement that the pin terminals (6*a*, 6*b*) mate with corresponding contact pieces (10*a*, 10*b*) when said male half (2) is inserted in said cavity (7) of said female half (1), and a seal member placed in the space which is to be formed between the outer surface of said plug housing (9) and the inside surface of said socket housing (5) when said male and female halves (2) and (1) are coupled, thereby preventing water from invading the inside of the electric connector, characterized in that said plug housing (9) has a plurality of hollow protrusions each having a cylindrical cell (13*a*, 13*b*) to permit each of said contact pieces (10*a*, 10*b*) to fit in, said seal member (14) encircling each of said protrusions, thereby sealing each pin-and-contact piece connection independently from adjacent pin-and-contact piece connection said seal member (14) being made of a unitary structure, which has a front surface (17), a rear surface (31), a circumferential side (15) connecting the front and rear surfaces, and a plurality of through holes each permitting a corresponding protrusion to enter therein, said seal member being placed with its front surface (17) on the bottom (18) of said cavity (7) and with its circumferential side (15) on the inside circumference (16) of said cavity (7), each of said through holes having hills (24) and valleys (23) alternately formed on its inside surface (22), the hills (24) of each through hole being pressed against the outer surface of a corresponding protrusion.

2. A waterproof type of electric connector according to claim 1 wherein it further comprises a seal stopper (26) placed in said cavity (7) with its front end (30) on the rear surface (31) of said seal member (14) and with its outer surface on the inside surface of said cavity (7), whereby said stopper (26) is sandwiched between said socket housing (5) and said plug housing (9) to hold said seal member (14) in place when said male and female housing are mated.

3. A waterproof type of electric connector according to claim 2 wherein said contact pieces (10*a*, 10*b*) are of pressure-contact type.

* * * * *